United States Patent [19]

Oellers

[11] 4,080,688

[45] Mar. 28, 1978

[54] DEVICE FOR CLEANING TEXTILE FIBER FLOCKS

[75] Inventor: Walter Oellers, Monchen-Gladbach, Germany

[73] Assignee: Trutzschier GmbH & Co. KG, Monchen-Gladbach, Germany

[21] Appl. No.: 689,981

[22] Filed: May 26, 1976

[30] Foreign Application Priority Data

May 31, 1975 Germany ..... 2524245

[51] Int. Cl.[2] ..... D01G 37/00

[52] U.S. Cl. ..... 19/204

[58] Field of Search ..... 19/65 R, 200, 105, 204, 19/205, 81; 209/307, 308, 22–29; 198/622, 623, 624, 480

[56] References Cited

U.S. PATENT DOCUMENTS

| | | | |
|---|---|---|---|
| 1,865,234 | 6/1932 | Cheshire | 19/65 R |
| 2,694,229 | 11/1954 | Gardes | 19/204 |
| 3,846,871 | 11/1974 | Kolbach | 19/155 X |

FOREIGN PATENT DOCUMENTS

| | | | |
|---|---|---|---|
| 644,118 | 4/1937 | Germany | 19/204 |
| 158,506 | 11/1932 | Switzerland | 19/204 |
| 465,541 | 1/1969 | Switzerland | 19/81 |
| 907,712 | 10/1962 | United Kingdom | 19/105 |

*Primary Examiner*—Dorsey Newton

*Attorney, Agent, or Firm*—Haseltine, Lake & Waters

[57] ABSTRACT

A device for cleaning textile fiber flocks, comprising a conveyor band of a material that is penetrable by air, means for continuously feeding textile fiber flocks onto the upper run of the conveyor band and means for sucking air from below through the upper run when covered by a layer of the flocks, and a rotatable roller having elastically flexible leaves that protrude freely in radial directions and are substantially parallel to the axis of the roller, in proximity of the delivery end of the conveyor band and running in the same direction in which the upper band run moves, at such a high speed that the circumferential speed of the ends of the leaves is somewhat greater than that of the band, the roller being arranged in such a manner that the ends of the leaves strike, during their rotation, a point of the conveyor band that is not supported. A gap or interstice is provided between the roller and the conveyor band. The invention also provides optional, additional features for the cleaning device.

2 Claims, 1 Drawing Figure

DEVICE FOR CLEANING TEXTILE FIBER FLOCKS

Figure 1:
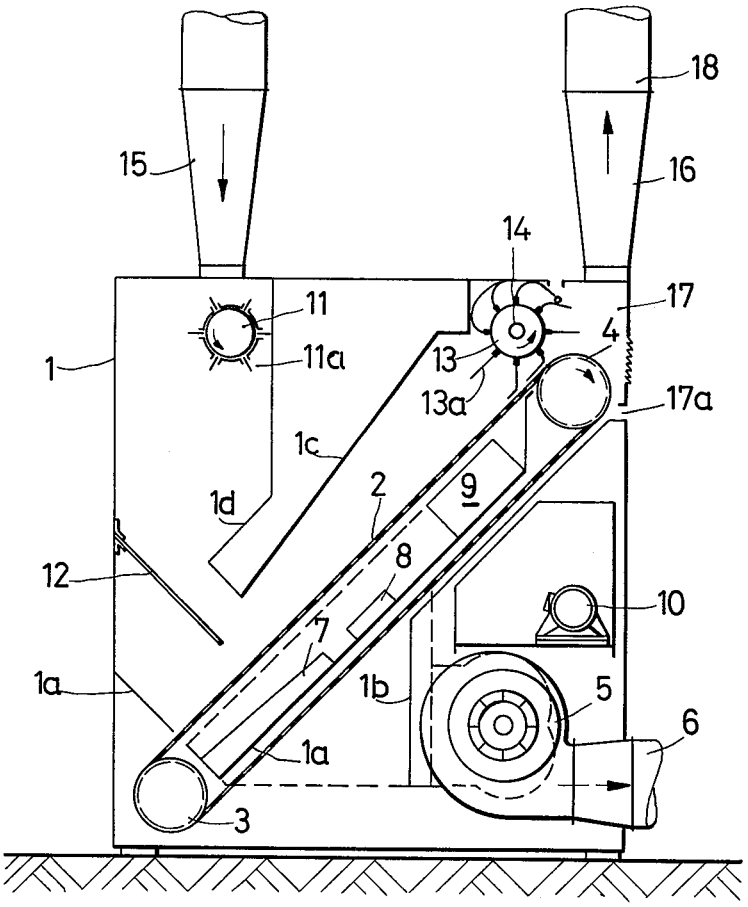

The invention relates to a device for cleaning textile fiber flocks, especially for removing dust therefrom.

Such devices serve to remove impurities, hereinafter referred to as waste, that are contained in the flocks. Small and light waste particles, in particular dust, are separated in unsatisfactory quantities with usual cotton cleaning machines that separate the waste particles by means of centrifugal force. It is also known to separate dust and small waste particles from textile fiber flocks by the aid of the air that is passed through condensors.

It has, however, been experienced that the degree of cleaning achieved with the usual cotton cleaning machines and condensors is not sufficient, particularly for the open-end rotor spinning process, particularly if the fiber flock mass contains a substantial proportion of small waste particles and/or dust.

A machine is known for cleaning cotton fiber flocks which has an endless, continuously running conveyor band, means for continuously feeding the textile fiber flocks onto the top of the conveyor band and means for sucking air from below through the conveyor band that is coated or covered with the layer of fiber flocks (U.S. Pat. No. 1,865,234).

The object of the present invention is to improve such machines so that the degree is considerably increased to which dust can be removed.

According to important features of the invention this is solved in that a roller rotates in proximity to the delivery side of the conveyor band, the roller having elastically very flexible leaves that protrude freely in the radial direction and are substantially parallel to the rotor axis. The rotational speed of the roller is so high that the circumferential speed of the ends of the leaves is somewhat greater than the speed of the conveyor band. The arrangement is such that the ends of the leaves strike a point of the conveyor band that is not supported.

This roller is preferably arranged opposite the delivery end of the conveyor band such that the leaves occupy a position tangential to the roller over a considerable portion of their lengths during their passage through a gap between the roller and the conveyor band, and strip off cotton flocks from the band as they re-straighten.

A grate is preferably provided above the feed end of the conveyor band, and a roller with wings, disposed below the supply of the textile fiber flocks above the grate, the roller circulating with such a speed that it accelerates the flocks in the direction of the grate.

The conveyor band is preferably inclined to the horizontal so that the feeding end lies somewhat deeper than the delivery end.

The invention will be more fully understood with reference to the following description, when considered in conjunction with the accompanying drawing, the sole FIGURE of which shows an exemplary embodiment of the invention, namely a longitudinal section through a device for cleaning textile fiber flocks.

The device includes a housing 1 with an endless conveyor band 2 provided therein, the housing being substantially airtight except in places that will be mentioned in the following. The band runs about two rollers 3, 4, having substantially horizontal axes, and is put into movement by the rotation of one of these rollers (not shown in detail). The band 2 extends preferably approximately diagonally to the housing 1, as shown.

The conveyor band 2 is composed of a material that is well penetrable by air but does not allow textile fibers to pass therethrough. Preferably it consists of a sufficiently fine wire mesh in which the upper surfaces are as large as the surfaces occupied by the wires. As mentioned before, the diagonal arrangement of the conveyor band 2 provides an angle of about 45° to the horizontal.

A wall 1*a* of the housing 1 is disposed between the upper and the lower run of the band 2. Together with a wall 1*c* of the housing, and a roller 13 to be described later in more detail, the wall 1*a* separates the upper space of the housing, through which the upper part of the conveyor band 2 passes, from the lower space, which is traversed by the lower run of the same band, as can be seen from the drawing.

A fan 5 is positioned in the housing 1, with ventilating outlets 6 which open to the open air or can be connected to an exhaust air duct (not shown). The fan 5 is driven by a motor 10 but is arranged in the housing. The suction side of the fan leads through suction canals to openings 7, 8 and 9 that are provided in a space between the upper run of the conveyor band 2 and the lower run.

A roller 11, that rotates relatively fast about a horizontal axis, and having leaves 11*a* protruding widely in radial directions and extending over the complete length of the roller, is situated below the discharge end of a chute 15 for the intake of textile fiber flocks to be cleaned. The flocks are preferably conveyed pneumatically (not shown) to the chute, and another chute 16 is provided for pneumatically discharging the cleaned fiber flocks, both chutes connecting to the upper portion of the housing 1, to which further reference will be had later.

A grate 12 is arranged below the roller 11, essentially at right angles to the direction of the conveyor band 2, as can be seen in the drawing. The upper end of the grate 12 reaches to the wall of the housing 1, whereas the lower end reaches close to the top run of the conveyor band 2. The direction of the latter is shown by a small clockwise arrow inside the upper roller 4.

The grate 12 is composed of parallel rods that are spaced close to one another so that the textile flocks cannot fall through them. A wall 1*d* of the housing, that lies essentially at right angles to the plane of the grate 12, is provided below the roller 11 opposite to the grate and spaced therefrom.

Between the upper end of the wall 1*c* of the housing 1 and the upper end of the top run of the conveyor band 2, the roller 13 is provided that has leaves 13*a* that protrude widely in radial directions, these leaves extending over the complete length of the roller and having such a great length in radial directions that the distance of the top edges from the axis 14 of the roller 13 is considerably greater than the distance of the same axis from the plane or surface of the top run of the conveyor band 2 at this location.

The leaves 13*a* of the roller 13 periodically strike with their ends the layer of fiber flocks on the top run of the conveyor band 2 at a point where it is not directly supported, as shown, and consequently the band is vibrated. The leaves 13*a*; then lying on or at least touching the layer of fiber flocks, travel with them over a short distance, in the same direction, as shown in the drawing with respective arrows (at "4" and "13"), through the interstice or gap between the roller 13 and the conveyor band 2. The leaves 13*a* then move along between the band 2 and the roller 13. While the leaves 13*a* re-straighten themselves, this links the fiber flocks that lie on the conveyor band 2 into the area below the discharge chute 16.

The transportation of the fiber flocks to be cleaned to the chute 15, and the cleaned flocks from the chute 16, may be achieved in a preferred way. In the exemplary embodiment of the inventive device, this is suggested to be achieved pneumatically in that the cleaned fiber flocks can reach a space 17 above the roller 4, the wall of this space having narrow opening or slits 17*a* through which the transporting air can enter, by which the cleaned flocks are then conveyed through the chute 16 to a pipe 18 that can lead to a suction fan (not shown) that sucks off the cleaned material.

In a practical embodiment, the conveyor band 2 may have a width of 1 meter, the lengths of the rollers 11, 13 being substantially equal; the width of the housing 1 is somewhat larger, it should be understood. The circumferential speed of the conveyor band 2 can be regulated preferably between 125 and 625 millimeters per second. The roller 13 and the conveyor band 2 have the same motor, coaxial with either the roller 4 or the roller 13, or separate therefrom, whereby both can be driven at appropriate speeds. The roller 13 is preferably driven at this speed so that the leaves 13*a* that lie on the layer of fiber flocks atop the upper conveyor run move at a speed somewhat greater than the conveyor band itself but in the same direction. Thus, the flock layer is advanced over the conveyor belt and consequently stripped therewith. The respective movements or rotational directions of the band 2 and the roller 13 are conducive to conveying the cleaned fiber flocks into the earlier-mentioned space 17.

As a matter of example, the difference in the speeds between the belt 2 and the roller 13 may amount to 55%, the outer diameter of the roller 13 with the extended leaves 13*a* may be 470 millimeters, with a drum diameter of 200 millimeters. The speed of the air flow in the area between the top of the conveyor band 2 and the wall 1*a* may amount to 3 meters per seconds, while the rotational speed of the roller 12 may be 600 revolutions per minute, at an outer diameter of 300 millimeters.

It will be understood by those skilled in the art that several modifications, changes, additions and omissions can be made in the inventive device without departing from the spirit and scope of the present invention.

What I claim is:

1. A device for cleaning textile fiber flocks, comprising: an endless continuously running conveyor band of a material that is penetrable by air, means for continuously feeding textile fiber flocks onto the upper run of said conveyor band and means for sucking air from below through said upper conveyor run when covered by a layer of the fiber flocks, grate means disposed above the feeding end of said conveyor band and a first roller having wings, disposed below a supply for the fiber flocks, provided above said grate means, said second roller running at a speed adapted to accelerate the fiber flocks in the direction of said grate means, and a second rotatable roller having elastically very flexible leaves that protrude freely in radial directions and are substantially parallel to the axis of said roller above said upper conveyor run, in proximity of the delivery end of said conveyor band and running at such a high speed that the circumferential speed of the ends of said leaves is somewhat greater than the speed of said conveyor band and running in the same direction in which said upper conveyor run moves, said roller being arranged in such a manner that said ends of the leaves strike a point of said conveyor band during their rotation that is not supported.

2. A device for cleaning textile fiber flocks comprising; an endless running conveyor band of a material that is penetrable by air, means for continuously feeding textile fiber flocks onto the upper run of said conveyor band and means for sucking air from below through said upper conveyor band run when covered by a layer of the fiber flocks, said delivery end of the conveyor band feeds into a space having a pneumatic delivery pipe connected thereto for discharging the fiber flocks from said space, and a rotatable roller having elastically very flexible leaves that protrude freely in radial directions and are substantially parallel to the axis of said roller, above said upper conveyor run in proximity of the delivery end of said conveyor band and running at such a high speed that the circumferential speed of the ends of said leaves is somewhat greater than the speed of said conveyor band and running in the same direction in which said upper conveyor run moves, said roller being arranged in such a manner that said ends of the leaves strike a point of said conveyor band during their rotation that is not supported.

* * * * *

UNITED STATES PATENT AND TRADEMARK OFFICE

CERTIFICATE OF CORRECTION

PATENT NO. : 4,080,688

DATED : March 28, 1978

INVENTOR(S) : OELLERS

It is certified that error appears in the above-identified patent and that said Letters Patent are hereby corrected as shown below:

Please change Assignee from "Trutzschier GmbH & Co. KG" to

--Trützschler GmbH & Co. KG--

Signed and Sealed this

*Twenty-eighth* Day of *November 1978*

[SEAL]

*Attest:*

RUTH C. MASON
*Attesting Officer*

DONALD W. BANNER
*Commissioner of Patents and Trademarks*